US006182641B1

(12) United States Patent
Yamada et al.

(10) Patent No.: US 6,182,641 B1
(45) Date of Patent: Feb. 6, 2001

(54) FUEL VAPOR CONTROL SYSTEM FOR INTERNAL-COMBUSTION ENGINE

(75) Inventors: Jun Yamada; Kenji Kanehara, both of Nishio; Hiroshi Okano; Kazuhiko Norota, both of Toyota, all of (JP)

(73) Assignees: Nippon Soken, Inc., Nishio; Toyota Jidosha Kabushiki Kaisha, Toyota, both of (JP)

( * ) Notice: Under 35 U.S.C. 154(b), the term of this patent shall be extended for 0 days.

(21) Appl. No.: 08/836,256

(22) PCT Filed: Oct. 16, 1996

(86) PCT No.: PCT/JP96/03002

§ 371 Date: Sep. 12, 1997

§ 102(e) Date: Sep. 12, 1997

(87) PCT Pub. No.: WO97/14883

PCT Pub. Date: Apr. 24, 1997

(30) Foreign Application Priority Data

Oct. 16, 1995 (JP) ..... 7-266830

(51) Int. Cl.[7] ..... F02M 33/02
(52) U.S. Cl. ..... 123/519; 123/357
(58) Field of Search ..... 123/516, 518, 123/519, 520, 521, 198 D, 357, 385

(56) References Cited

U.S. PATENT DOCUMENTS 4,961,412 * 10/1990 Furuyama ..... 123/357
5,216,998 * 6/1993 Hosoda ..... 123/520
5,226,398 * 7/1993 Cook ..... 123/520
5,445,015 * 8/1995 Namiki ..... 123/520
5,559,706 * 9/1996 Fujita ..... 123/520
5,592,922 * 1/1997 Denz ..... 123/520
5,634,451 * 6/1997 Tomasawa ..... 123/520
5,635,633 * 6/1997 Kadota ..... 123/520

* cited by examiner

*Primary Examiner*—Carl S. Miller
(74) *Attorney, Agent, or Firm*—Pillsbury Madison & Sutro LLP

(57) ABSTRACT

A forward flow region in which forward intake air currents are produced and a reverse flow region in which reverse intake air currents are produced are formed in the throttle bore of a throttle body 3 included in an internal-combustion engine, and the boundary between those regions extends below a throttle valve 5. A fuel vapor control system for an internal-combustion engine has a purge tube 13 joined to the throttle body 3 to supply fuel vapor into the throttle body 3 and is provided with an opening 22 which acts as a purge port. The opening 22 is positioned at a distance from the inner surface 21 of the throttle body 3 defining a throttle bore on the boundary between the forward intake air currents and the reverse intake air currents. Fuel vapor jetted through the opening 22 of the purge tube 13 into the throttle bore flows toward an intake manifold 2, diffusing into both the forward intake air currents and the reverse intake air currents from the boundary between the intake air currents. Accordingly, the fuel vapor is distributed evenly through the intake manifold 2 to the cylinders, so that increase in the difference in air-fuel ratio between the cylinders can be suppressed. The purge port can relatively easily be formed, because the purge tube 13 provided with the purge port is fitted closely in a bore formed in the throttle body 3.

8 Claims, 21 Drawing Sheets

FUEL VAPOR CONTROL SYSTEM FOR INTERNAL-COMBUSTION ENGINE

TECHNICAL FIELD

The present invention relates to a fuel vapor control system for an internal-combustion engine and, more particularly, to an improved fuel vapor control system for an internal-combustion engine, capable of reducing the difference in air-fuel ratio between the cylinders of the internal-combustion engine. The present invention also relates to a fuel vapor control system for an internal-combustion engine, capable of being easily manufactured and assembled.

PRIOR ART

A fuel vapor control system for an internal-combustion engine disclosed in Japanese Unexamined Patent Publication (Kokai), i.e., JP-A-No. 6-213084 (U.S. Pat. No. 5,355,862) is a typical conventional fuel vapor control system.

This known fuel vapor control system has a charge passage having one end opening into an upper space in a fuel tank, and the other end connected to a canister connected to a purge (discharging) port. The purge port is connected to an opening formed in a wall defining a throttle bore behind a throttle valve disposed in an intake duct of an engine.

In the conventional fuel vapor control system having the purge port, downstream currents (forward currents) flowing from above toward below a throttle valve 100 and upstream currents (reverse currents) are produced near the inner surface of a wall defining a throttle bore 101 below the throttle valve 100 as shown in FIG. 19 when the throttle valve 100 is half open. The forward currents flow toward a cylinder #1 and the reverse currents flow toward a cylinder #4 in a surge tank 102 as shown in FIG. 20. Therefore, a large amount of fuel vapor flows into the cylinder #1 if the purge port opens into a region in which the forward currents prevail, whereas a large amount of fuel vapor (evaporated fuel) flows into the cylinder #4 if the purge port opens into a region in which the reverse currents prevail. Consequently, the resulting difference in air-fuel ratio (A/F ratio) between the cylinder #1 and the cylinder #4 can create problems.

If a large amount of fuel vapor needs to be purged (discharged) to meet a future intensified fuel evaporative emission control regulation, there is the possibility that the difference in A/F ratio between the cylinders of an engine increases, and the deterioration of drivability and the deterioration of exhaust emission attributable to misfiring result. In FIGS. 19 and 20, indicated at 103, is a throttle valve shaft and at 105 is a throttle body.

FIG. 21 illustrates different regions of flows of intake air appearing in a cross section of the throttle body at a position 20 mm behind the throttle valve 100 when the throttle valve 100 is at a predetermined opening, for example, 14°. Indicated at A in FIG. 21 are boundaries between the forward currents and the reverse currents of intake air. Although the difference in A/F ratio between the cylinders of an internal-combustion engine can be reduced by opening the purge port at a position on the boundary A, the purge port at the position on the boundary A lies inevitably near the shaft 103 of the throttle valve 100 and hence a difficult machining operation is required to form the purge port.

SUMMARY OF THE INVENTION

An object of the present invention is to provide a fuel vapor control system for an internal-combustion engine, capable of solving problems encountered by the prior art.

Another object of the present invention is to provide a fuel vapor control system for an internal-combustion engine, provided with a control system for properly returning fuel vapor to an intake system and capable of suppressing increase in the difference in A/F ratio between the cylinders of an internal-combustion engine.

A further object of the present invention is to provide a fuel vapor control system for an internal-combustion engine, provided with an improved fuel vapor purge port.

A still further object of the present invention is to provide a fuel vapor control system for an internal-combustion engine, capable of being relatively easily manufactured and assembled.

In accordance with one aspect of the present invention, there is provided a fuel vapor control system for an internal-combustion engine which comprises a canister packed with an adsorbent for adsorbing fuel vapor evaporated in a fuel tank, a purge port forming means placed in an intake passage of the internal-combustion engine, a purge passage means fluidly interconnecting the canister and the purge port forming means, a purge rate control means arranged in the purge passage means to control a purge rate at which a fuel vapor is purged, a fuel supply means for supplying fuel to the internal-combustion engine, and a purge correction control means for controlling a fuel supply to the internal-combustion engine depending on the controlled purge rate, the purge port forming means defining a purge port for jetting fuel vapor onto the boundary between forward intake air currents and reverse intake air currents produced in a region below a throttle valve disposed in the intake passage.

Preferably, the purge port is arranged in a throttle body at a position below a throttle valve, and a fuel vapor outlet of the purge port is formed so as to project from the inner surface of a throttle body defining a throttle bore forming a portion of the intake passage into the throttle bore.

The purge port forming means may have a tapered portion tapered toward its extremity and the purge port may be formed at the extremity of the tapered portion.

A purge tube member included in the purge port forming means may be disposed between the shaft of the throttle valve and an end surface of the throttle body connected to a surge tank in the throttle body, and the purge port may be formed in the purge tube member at a position at a distance in the range of 2% to 20% of the diameter of the throttle bore from the surface of the throttle bore.

Preferably, the extremity of the purge tube is formed so as to have a beveled end surface, and an opening formed in the beveled end surface of the purge tube opens toward the surge tank. In this construction, the purge tube member must be held on the throttle body so that the purge tube member is unable to turn relative to the throttle body.

The extremity of the purge tube may be closed and a circumferential slit for adding fuel vapor may be formed in a portion of a side surface facing the surge tank, at a position near the extremity of the purge tube. In this construction, the purge tube member must be held so that the purge tube member is unable to turn relative to the throttle body.

The purge tube may be biased to the right or to the left with respect to the center of a cross section of the throttle bore.

The purge tube may be inclined relative to the throttle body so that the opening formed in its end surface faces the surge tank.

The operation of the present invention will be described.

Suppose that fuel vapor spouts out through the purge port into the throttle bore. Then, the fuel vapor flows into the surge tank, diffusing at the boundary between the forward intake air currents and the reverse intake air current into both the forward intake air currents and the reverse intake air currents produced in the throttle bore, because the purge port is formed at a position on the boundary below the throttle valve. Since the fuel vapor diffuses into the intake air currents, the fuel vapor is distributed evenly to all the cylinders, so that the difference in A/F ratio between the cylinders can be suppressed.

BRIEF DESCRIPTION OF THE DRAWINGS

Further description of the above and other objects, features and advantages of the present invention will be made with reference to the accompanying drawings, wherein.

BEST MODE FOR CARRYING OUT THE INVENTION

A preferred embodiment of the present invention will be described hereinbelow with reference to FIGS. 1 to 7.

Figure 1:
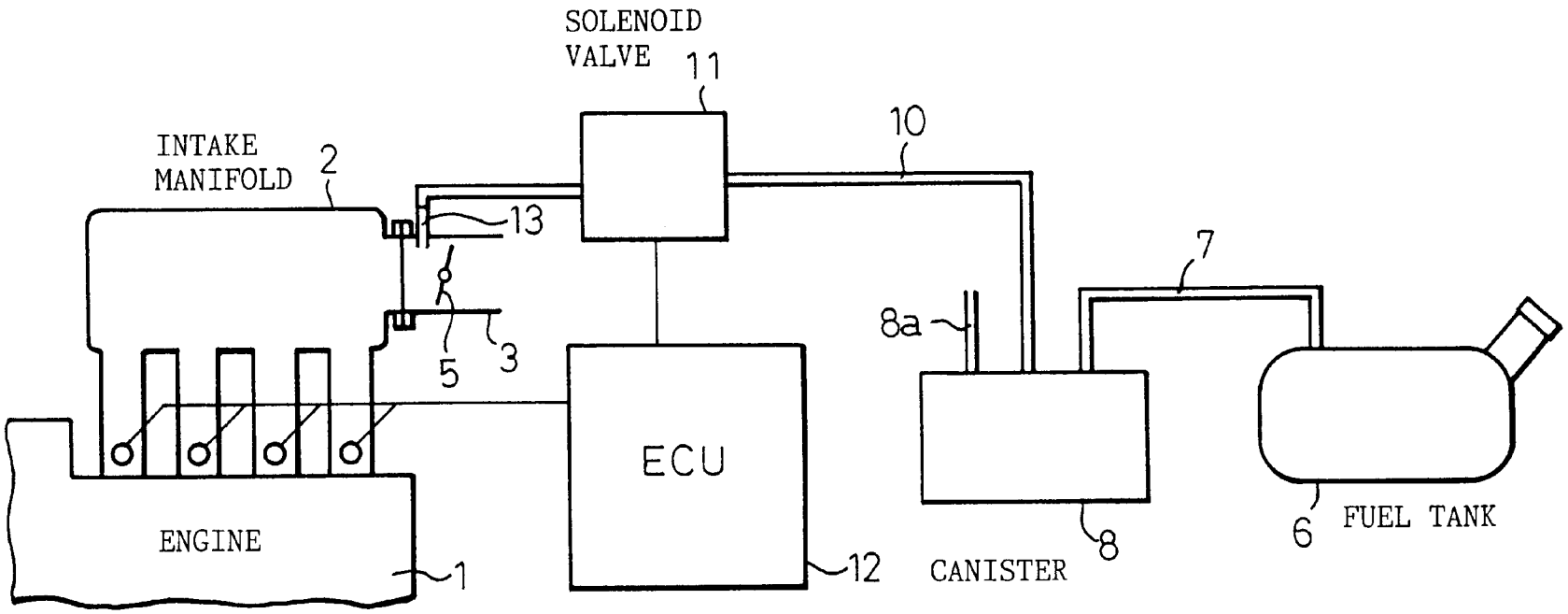
FIG. 1 is a schematic block diagram of a fuel vapor control system for an internal-combustion engine, according to the present invention.

Referring to FIG. 1 schematically illustrating a fuel vapor control system for an internal-combustion engine, in a preferred embodiment according to the present invention, the engine 1 receives intake air through an intake manifold 2, and a throttle body 3 is joined to the intake manifold 2. The throttle body 3 is provided with a throttle valve 5 for regulating the flow rate of the intake air to be fed to the engine 1.

Fuel to be supplied into the engine 1 is stored in a fuel tank 6. Fuel vapor, i.e., evaporated fuel, evaporated in the fuel tank 6 is guided through a vapor passage 7 to a canister 8 while the engine is in operation or out of operation, and the fuel vapor is trapped for temporary storage by an adsorbent, such as activated carbon, packed in the canister 8.

The canister 8 is connected to a throttle body 3 disposed below the throttle valve 5 by a purge passage 10. An operation mode in a predetermined operation mode (for example, a mode in which the engine is loaded with a medium to high load and is operating at medium to high engine speeds, the temperature of the cooling water is 80° C. or above and feedback control operation is performed), in which air sucked through an air inlet port 8*a* of the canister into the canister 8 is sucked into the throttle body 3 by a vacuum pressure, the fuel vapor trapped by the activated carbon is released from the activated carbon by the flow of the air and is sucked into the throttle body 3. The above-mentioned operating mode for conducting the purging will be referred to as a purge mode throughout the description of the present application.

A solenoid valve 11 which can act so as to linearly vary the passage area of the purge passage 10 is placed in the purge passage 10, and the duty factor of the solenoid valve 11 is controlled by an electronic control unit (ECU) 12.

The outlet end of the purge passage 10 is pressed into a bore formed in the throttle body 3 and is connected to a purge tube 13 projecting into the interior of the throttle body 3. The purge tube 13 is provided at its extremity with a purge port. The purge tube 13 constitutes a purge port forming means.

The electronic control unit (ECU) 12 receives signals indicating the current operating condition of the engine, such as a signal indicating the temperature of the cooling water flowing through the engine 1 from a water temperature sensor, not shown, a signal indicating an air-fuel ratio from an O2 sensor, not shown, disposed in an exhaust passage, not shown, a signal indicating the flow rate of intake air from a flow meter, not shown, and a signal indicating an engine speed from a crank angle sensor, not shown, associated with a distributor, not shown. The electronic control unit (ECU) 12 calculates a fuel injection period (fuel injection quantity) TAU appropriate for the operating condition on the basis of the signals received from those sensors, and drives a fuel injector mounted on the intake manifold 2 to inject the fuel for the fuel injection period TAU.

The purge tube 13, i.e., the purge port forming means, of the fuel vapor control system of the present invention for the internal-combustion engine will be described in further detail with reference to FIGS. 2 and 3.

Figure 2:
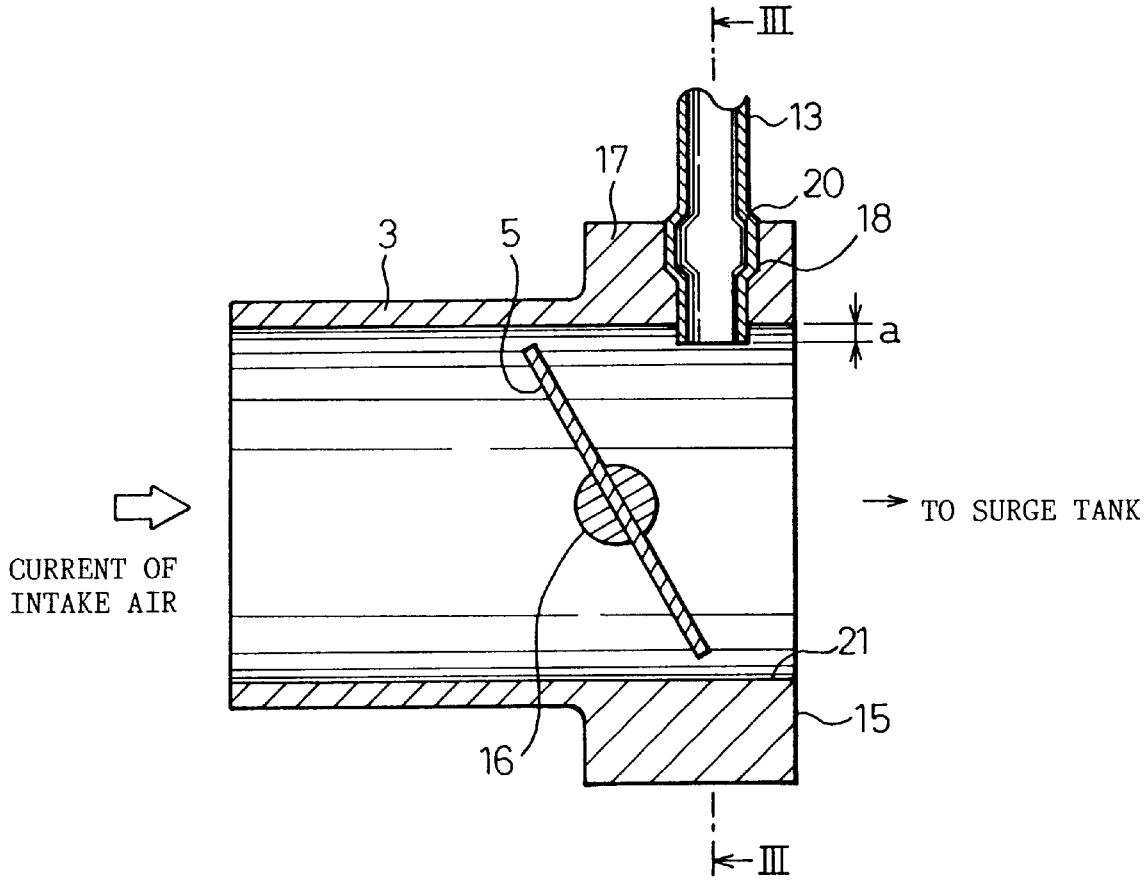
FIG. 2 is a cross-sectional view of a purge tube accommodated in a fuel vapor control system for an internal-combustion engine, according to a first embodiment of the present invention.
Figure 3:
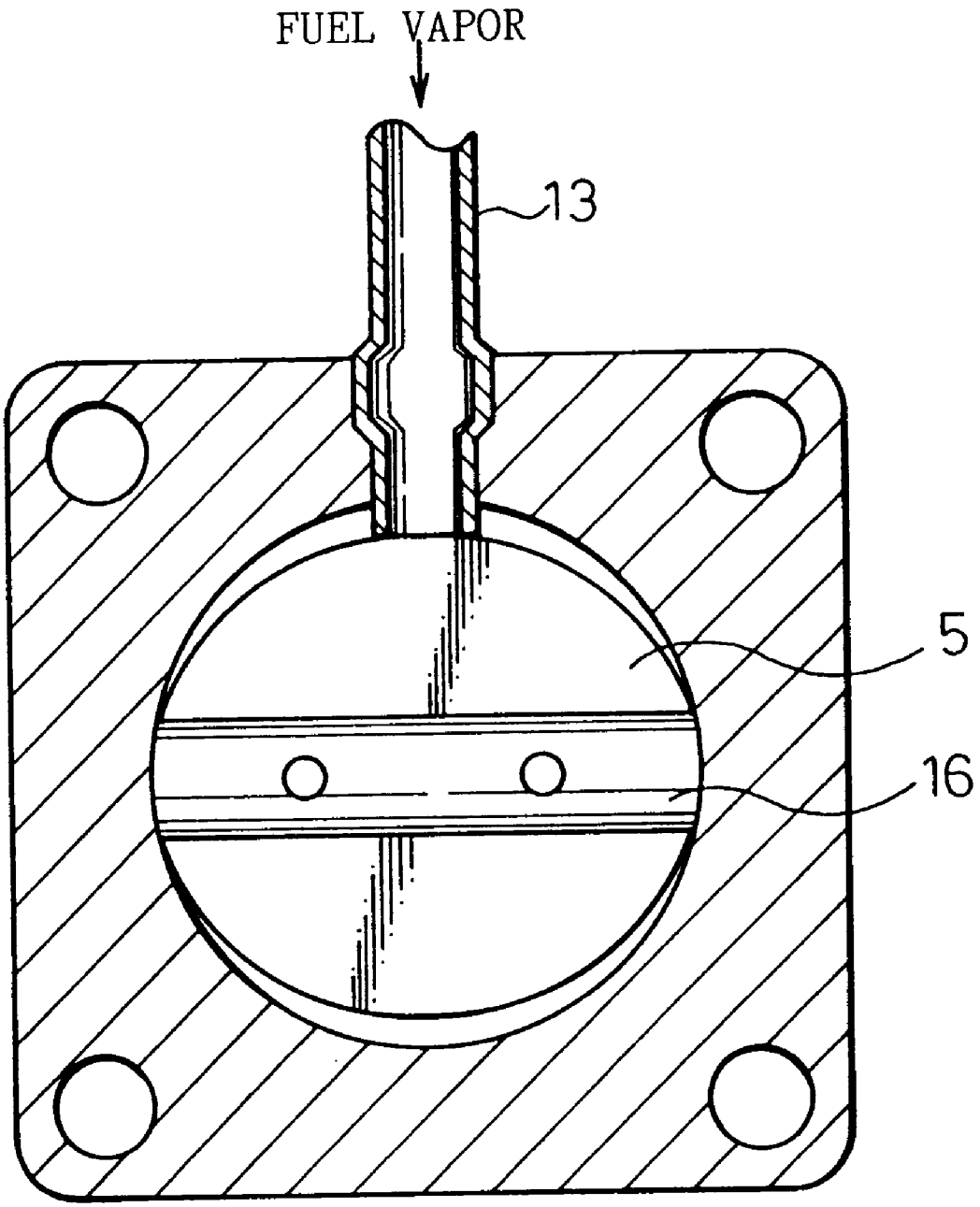
FIG. 3 is a cross-sectional view taken along the line III—III of FIG. 2.

Referring to FIGS. 2 and 3, one end surface 15 of the throttle body 3 is joined to the intake manifold 2, and a stepped bore 18 is formed in an expanded portion 17 having an increased wall thickness and extending between the end surface 15 and a throttle valve shaft 16. The purge tube 13 having an expanded portion 20 and forming a portion of a purge port is fitted by press fitting into the bore 18 so as to project diametrically to the throttle bore by a length a from the inner surface 21 of the throttle body 3 defining the throttle bore. The length "a" of the portion of the purge tube 13 projecting into the throttle bore of the throttle body 3 may be a value in the range of 2% to 20% of the diameter of the throttle bore. Particularly, when the inside diameter of the purge tube 13 is 6 mm, a preferable value of the length a is about 5% of the diameter of the throttle bore. If the length "a" is in the foregoing range, fuel vapor spouted through the opening in the extremity of the purge tube 13 is able to flow into the surge tank while diffusing at the boundary of the currents in both forward currents and reverse currents.

The purge tube 13 is pressed into the bore 18 so that one end of the expanded portion 20 of the purge tube 13 is seated on a step formed in the bore 18, whereby the free end portion of the purge tube 13 is projected from the inner surface of the throttle body 3 by the fixed length a. The length "a" by which the free end portion of the purge tube 13 projects from the inner surface of the throttle body 3 can be adjusted by changing the length of a portion of the purge tube 13 between its extremity and the end of the expanded portion 20.

Figure 4A:
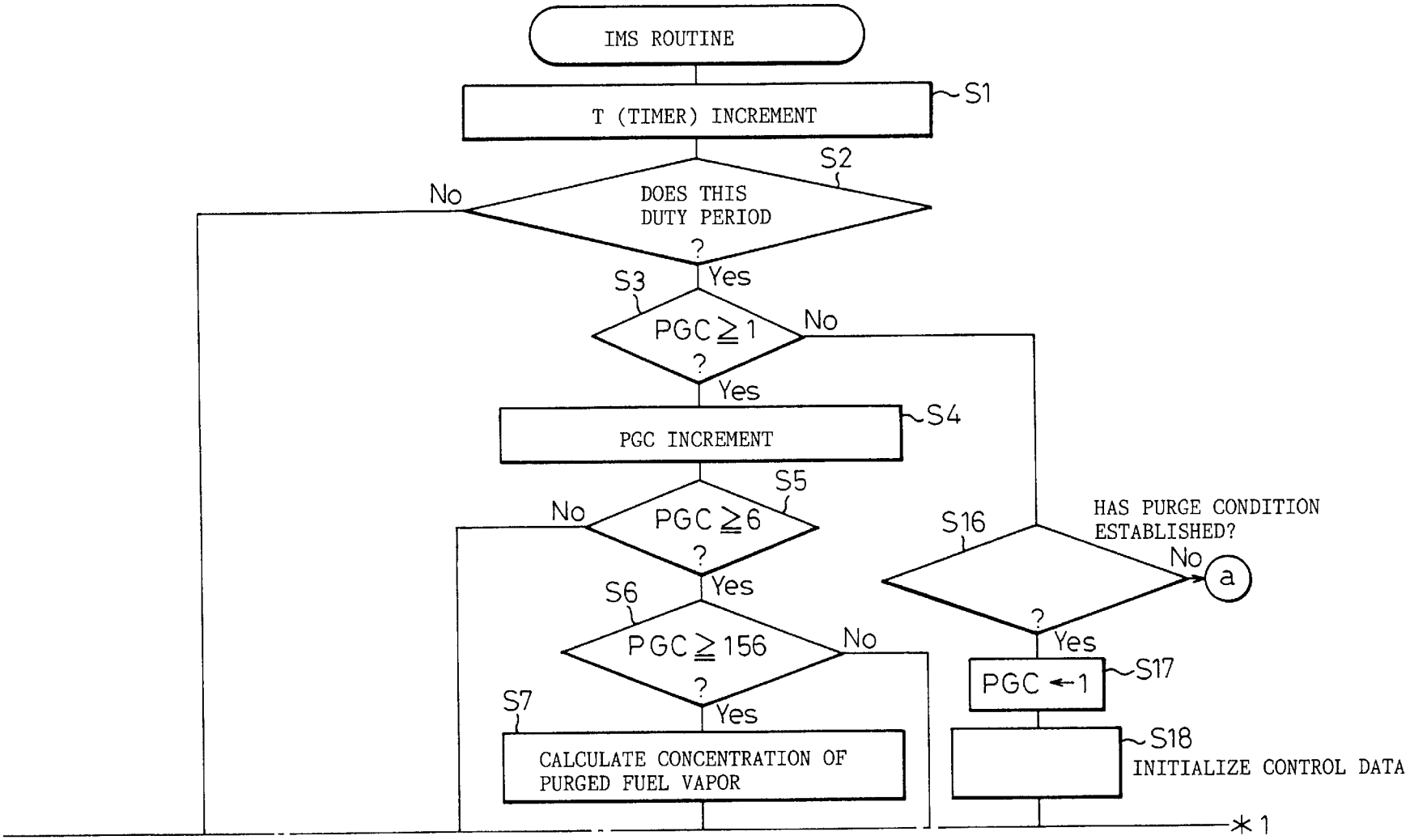
FIGS. 4A and 4B are flow charts of operations to be carried out by the fuel vapor control system.
Figure 4B:
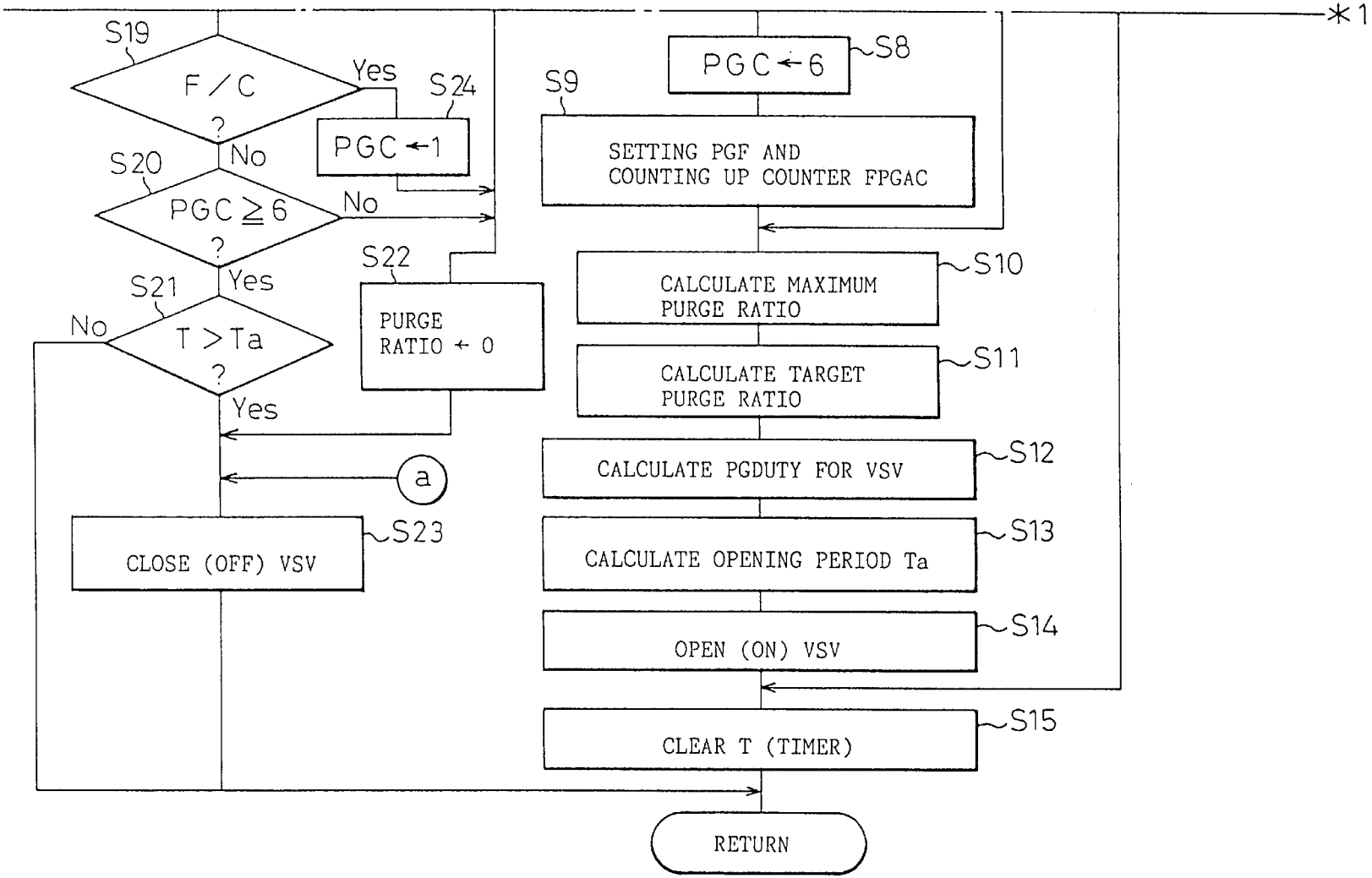

The operation of the electronic control unit (ECU) 12 will be described with reference to flow charts shown in FIGS. 4A and 4B. A program represented by the flow charts of FIGS. 4A and 4B may be a routine which is repeated every 1 $\mu$s (microsecond).

A timer counter counts up to increment its count T by one in step S1 each time the routine is executed. A query is made in step S2 to see if this cycle of the routine corresponds to a control period of a control operation for controlling the solenoid valve 11 (a period for determining the duty factor of the solenoid valve 11); that is, if the period of control operation for controlling the solenoid valve 11 is 100 $\mu$s, a query is made to see if T≧100.

If the present time corresponds to the control period (if the response in step S2 is affirmative), a query is made in step S3 to see if the count PGC of a purge counter to count up is 1 or above when the operating condition of the engine corresponds to the foregoing purge tube condition; that is, a query is made to see if a purge condition has been established by the preceding cycle.

If the response in step S3 is negative, a query is made in step S16 to see if the purge condition has been established.

If the purge condition has been established (if the response in step S16 is affirmative), the count PGC of the purge counter is set at 1 in step S17, and various characteristics necessary for purge control are initialized (for example, duty factor=0) in step S18 before starting purging. If it is decided in step S16 that the purge condition is not established (if the response in step S16 is negative), a driving signal for driving the solenoid valve 11 is put out to close the purge passage 10 in step S23.

If it is decided that the count PGC of the purge counter is 1 or above and the purge condition has been established (if the response in step S3 is affirmative), the purge counter counts up in step S4. In step S5, a query is made to see if feedback control (F/B control) ii after the return of fuel cut (F/C) is stable in the present operating state meeting the purge condition from the time elapsed from the establishment of the purge condition; for example, a query is made to see if PGC≧6 (PGC=6 corresponds to 0.6 s in this embodiment, because the count PGC of the purge counter is incremented every 100 $\mu$s). Therefore, if the response in step S5 is negative, i.e., if it is decided that feedback control is not stabilized, step S22 is executed to initialize purge ratio (=(quantity of purge)/(quantity of intake air)), i.e., purge ratio is set at 0, and then step S23 is executed.

If the response in step S5 is affirmative, i.e., if it is decided that feedback control is stabilized, step S6 and the following steps are executed to calculate purge vapor concentration necessary for a fuel injection calculating routine, which will be described later, at predetermined time intervals (for example, every 15 s) during purging operation. A query is made in step S6 to see if PGC≧156 corresponding to a time period of 15 s after the start of purging. If the response in step S6 is affirmative, purge vapor concentration is calculated in step S7, the purge counter is set at 6 again in step S8 for the next purge vapor concentration calculation, operations for setting a purge learning flag PGF to be used in a fuel injection calculating routine, which will be described later, to the 1 state (PGF=1) and making a purge learning frequency counter FPGAC count up (initial value is 0) are carried out in step S9, and then the routine goes to step S10.

If the response in step S6 is negative, for example, PGC=6 and purge operation is about to be started, the routine skips steps S7, S8 and S9, and jumps to step S10.

In step S10, a maximum purge ratio MAXPG, i.e., the ratio of maximum purge quantity MAXPTQ to intake air quantity Q, is determined by using a map showing the relation between maximum purge quantity, i.e., the quantity of purge when the solenoid valve 11 is fully open, and unit intake air quantity Q/N, i.e., the quantity of intake air sucked per revolution of the engine (or intake vacuum PM in the intake pipe), determined through experiments in which the solenoid valve 11 is fully open, and interpolating the map by using the present unit intake air quantity Q/N calculated by using data provided by an airflow meter, not shown, and a crank angle sensor, not shown. In step S11, a target purge ratio TGTPG, i.e., the desired ratio of purge quantity to intake air quantity, is calculated in each control period, for example, 100 $\mu$s, by using an expression:

$$TGTPG=PGA*PG100\ ms/10$$

where PGA is a predetermined purge varying ratio a (unit; 1/10%/s, a=1, 2, 3, . . . )

PG100 ms: The count of a counter which counts up every 100 $\mu$s if A/F ratio feedback correction factor (hereinafter, referred to as "FAF") is within a predetermined range during feedback control or counts down if FAF is outside the predetermined range.

In step S12, a duty factor PGDUTY (=TGTPG/MAXPG) for a solenoid valve 9, i.e., the ratio of time for which the solenoid valve is open to the control period of 100 μs, is determined by using the thus determined maximum purge ratio MAXPG and the target purge ratio TGTPG. In step S13, the predetermined control period is multiplied by the duty factor PGDUTY to calculate an opening period Ta μs for which the solenoid valve 11 is opened, and a signal for opening the solenoid valve 11 is provided by the electronic control unit ECU 10 and, at the same time, the count T of the timer counter is cleared in step S14 to end the routine.

If the response in step S2 is negative, a query is made in step S19 to see if the present operating condition correspond to a fuel cut condition (F/C) in which feedback control (F/B) is not carried out. If the response in step S19 is negative, a query is made in step S20 to see if the count PGC of the purge counter is six or above to see if F/B is in a stable state.

If the response in step S19 is affirmative, the routine goes to step S22 after setting the count PGC at 1 in step S24. If the response in step S20 is negative, i.e., if the routine is not in a state to open the solenoid valve 11 at the present, step S22 is executed to set the purge ratio at zero, the opening signal for opening the solenoid valve 11 is put out in step S23, and then the routine is ended.

If the response in step S19 is negative and the response in step S20 is affirmative, i.e., if it is decided by the preceding cycle of the routine that the solenoid valve 11 is opened, a query is made in step S21 to see if the present count T of the timer counter is greater than a count (100×PGDUTY) corresponding to the opening period Ta calculated and determined in step S13. If the response in step S21 is affirmative, the operation to close the solenoid valve 11 is executed in step S23; otherwise step S23 is skipped and the routine is ended, because the solenoid valve 11 needs to be kept open.

Figure 5:
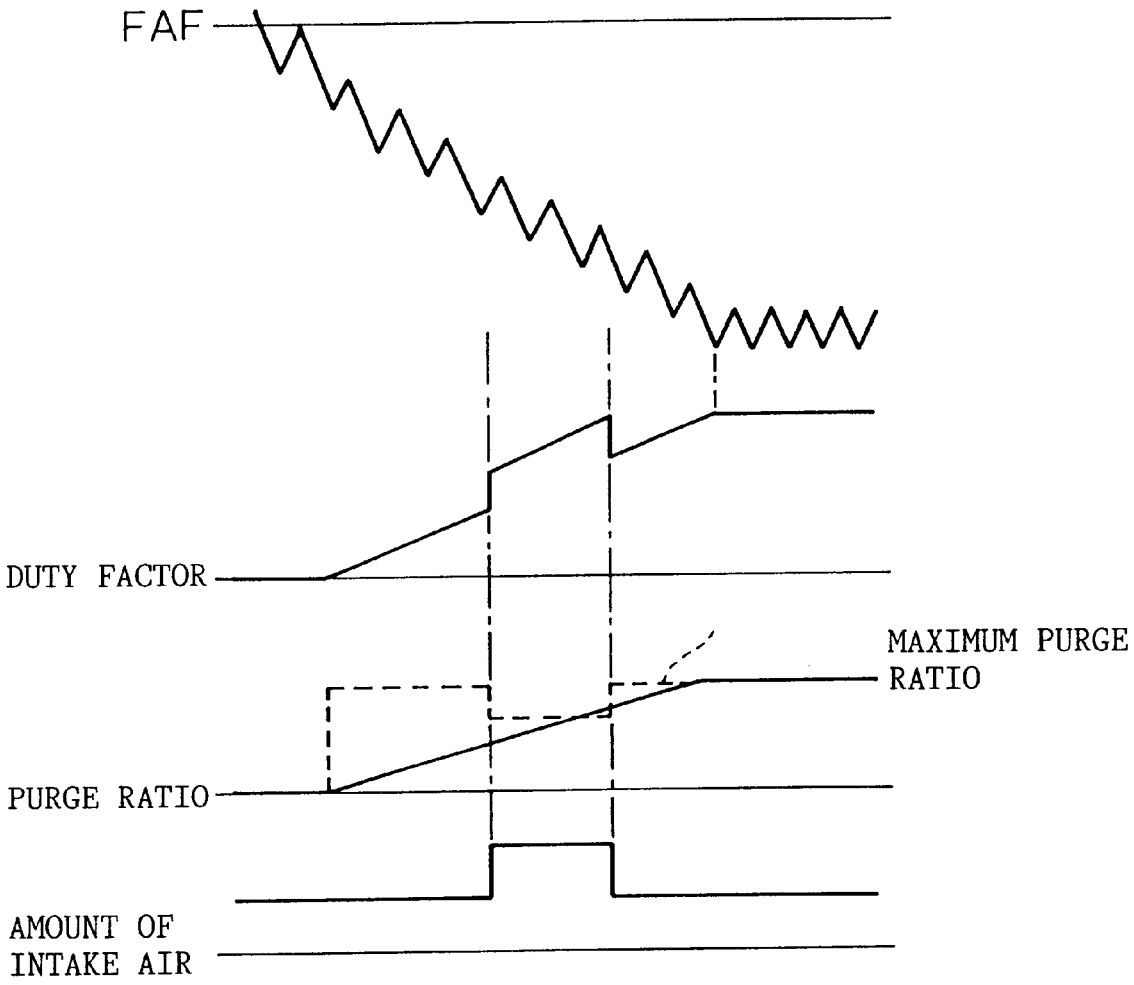
FIG. 5 is a diagram of assistance in explaining the variations of A/F ratio feedback correction factor, duty factor, purge rate and an amount of intake air, according to the purge control operation.

FIG. 5 indicates an example of a variation of FAF and a duty factor under a condition where an engine acceleration is made in a process wherein an actual purge ratio is increased to the maximum purge ratio when the purge operation is carried out by the fuel vapor control system according to the described embodiment of the present invention.

As is apparent from the indication of FIG. 5, the maximum purge ratio MAXPG shown by dotted lines is determined on the basis of the operating condition of the internal-combustion engine and corresponds, for example, to the amount of intake air indicated in FIG. 5. According to the foregoing program, the ratio of the actual purge ratio to the maximum purge ratio, i.e., the duty factor varies according to a change in the actual purge ratio if the amount of intake air is constant, because a gradual change (an increase) in the actual purge ratio relative to the maximum purge ratio occurs during the operation of the internal-combustion engine. Therefore, if the amount of intake air increases (if acceleration is performed) as indicated in FIG. 5 while the purge ratio increases gradually toward the maximum purge ratio, the maximum purge ratio calculated at that time point decreases and, consequently, the calculated duty factor increases.

Figure 7:
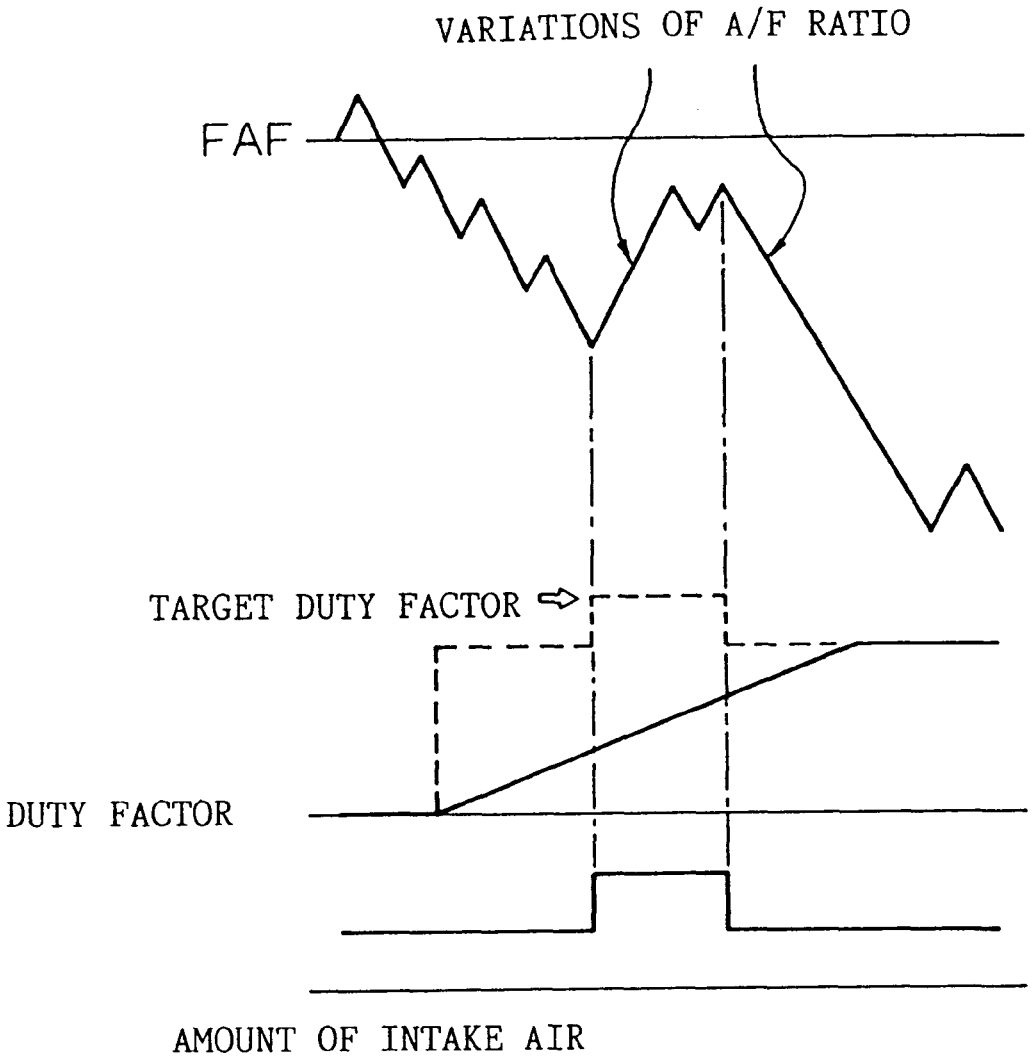
FIG. 7 is a diagram of assistance in explaining the characteristics of conventional techniques corresponding to those shown in FIG. 5.

That is, the foregoing embodiment changes the duty factor of the solenoid valve 11 instead of changing FAF (A/F ratio feedback correction factor) as shown in FIG. 7 when the intake air amount changes sharply. Thus, the amount of fuel vapor purged from the canister is controlled to suppress the variation of FAF in order that the irregular variation of A/F ratio is suppressed.

Figure 6:
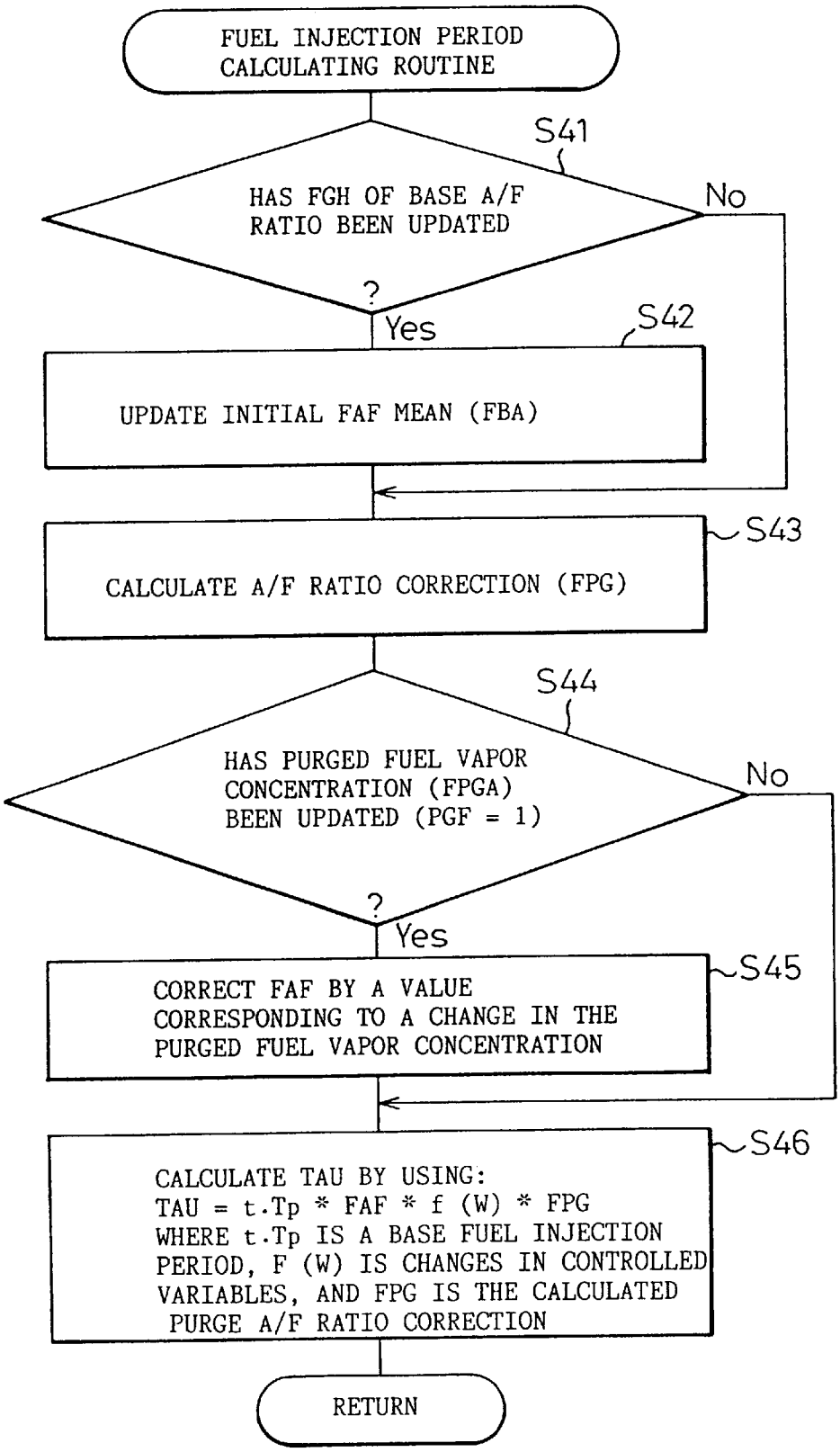
FIG. 6 is a flow chart of a procedure for calculating fuel injection period on the assumption that purge control operation is conducted.

FIG. 6 illustrates a routine for calculating the fuel injection period TAU to be used in executing the foregoing fuel vapor purging program. This routine is executed for every predetermined crank angle.

In step S41, a query is made to see if a learned value FGH of the base air-fuel ratio (A/F ratio) used in the preceding cycle of the routine has changed. If the learned FGH of A/F ratio is updated (if the response in step S41 is affirmative), an initial feedback value (FBA) stored immediately before starting purging as a mean FAF is changed in step S42 by a value corresponding to a value by which the learned A/F ratio is changed. Naturally, step S42 is skipped if the response in step S41 is negative, i.e., if purging is not executed and the learned FGH is not changed (if a purge flag PGF=0 in FIG. 6).

An A/F ratio correction (FPG) which is made to change by purging is calculated in step S43, and a query is made in step S44 to see if purged fuel vapor concentration (FPGA) is updated in this cycle, i.e., if PGF=1. If the purged fuel vapor concentration (FPGA) of this cycle is different from that of the preceding cycle (if the response in step S44 is affirmative), step S45 is executed correct FAF by a value corresponding to a change in the purged fuel vapor concentration FPGA. If PGF=0, i.e., if FPGA is not changed, step S45 is skipped.

In step S46, fuel injection period (fuel injection quantity) TAU is calculated by using a formula:

$$TAU = t \cdot Tp * FAF * f(W) * FPG$$

where FAF is the calculated A/F ratio feedback correction factor, FPG is the calculated purge A/F ratio correction, t·Tp is a base fuel injection period dependent on operating condition and F(W) is changes in acceleration, water temperature and such, and then the routine is ended.

Thus, this embodiment has, in addition to a capability to suppress the variation of A/F ratio, a capability to correct purge A/F according to the current purged fuel vapor concentration and purge ratio through the detection of FPGA at appropriate intervals as shown in step S7 of the routine shown in FIG. 4.

The operation of the invention will be described hereinafter. The fuel vapor thus controlled is jetted through the purge tube 13. Since the opening of the purge tube 13 is disposed at a position on the boundary between forward intake air currents and reverse intake air currents produced behind the throttle valve 5 and at a distance equal to 2% to 20% of the diameter of the throttle bore from the inner surface 21 defining the throttle bore, the fuel vapor jetted through the purge tube 13 diffuses in the throttle bore and flows into the surge tank, diffusing into both the forward intake air currents and the reverse intake air currents. Since the fuel vapor thus diffuses, the fuel vapor flows evenly into the cylinders of the engine 1, so that an increase in the difference in A/F ratio between the cylinders can be suppressed.

As the angle of the throttle valve increases, i.e., as the opening of the throttle valve 5 increases, the boundary between those currents changes and the distance between the position where the fuel vapor is jetted and the boundary increases. However, since the difference between the pressure in the throttle bore and that in the canister 8 decreases and the flow of the fuel vapor decreases, the difference in A/F ratio between the cylinders does not increase. When the throttle valve 5 is fully closed, currents of the fuel vapor are produced around an idling control port, not shown, and the flow velocity around the opening of the purge tube 13 is low if the idling control port and the purge tube 13 are independent. Therefore, the fuel vapor is dispersed and is distributed satisfactory and appropriate to the respective cylinders. The present invention is capable of suppressing an increase in the difference in A/F ratio between the cylinders under any operating condition of the engine.

A purge tube employed in a fuel vapor control system for an internal-combustion engine, according to the second embodiment of the present invention, will be described with reference to FIGS. 8 through 10, in which parts like or corresponding to those of the first embodiment are designated by the same reference characters and the description thereof will be omitted to avoid duplication, which also applies to the description of other embodiments which will be made later.

Figure 8:
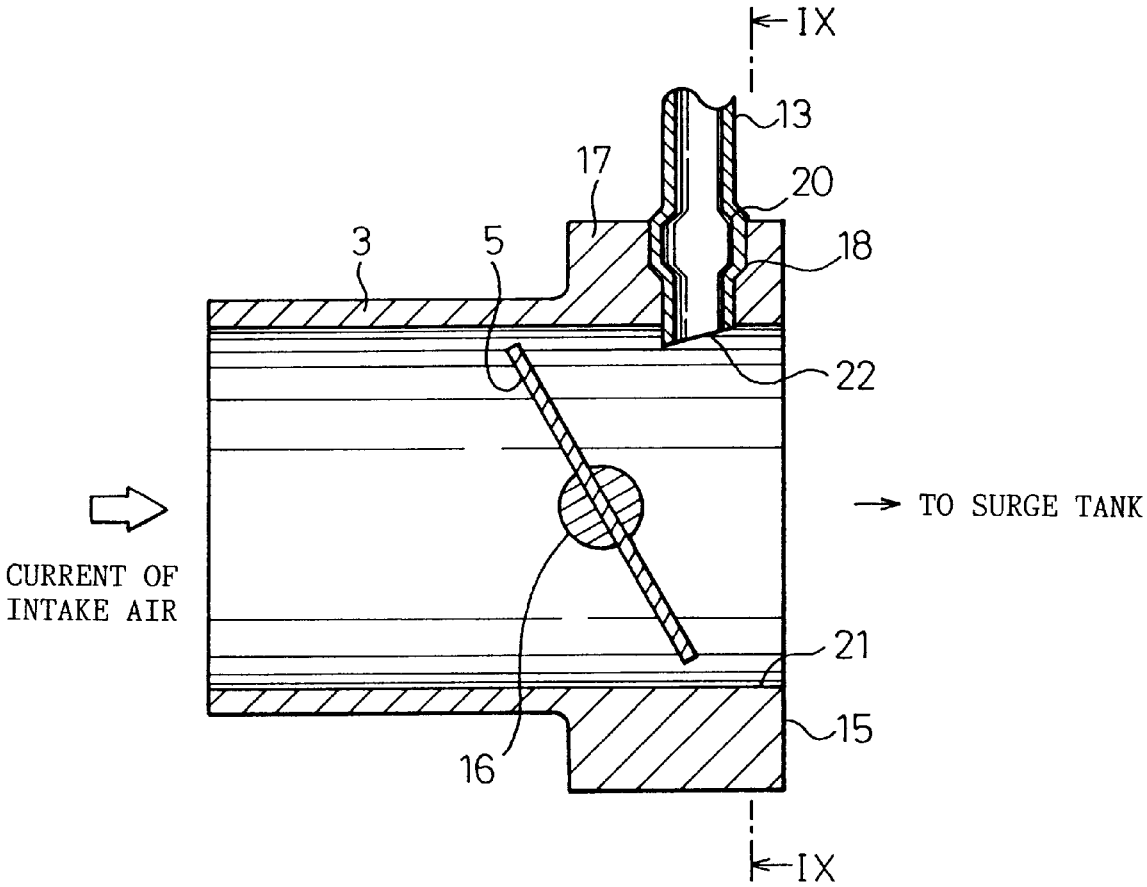
FIG. 8 is a cross-sectional view of a purge tube accommodated in a fuel vapor control system for an internal-combustion engine, according to a second embodiment of the present invention.
Figure 9:
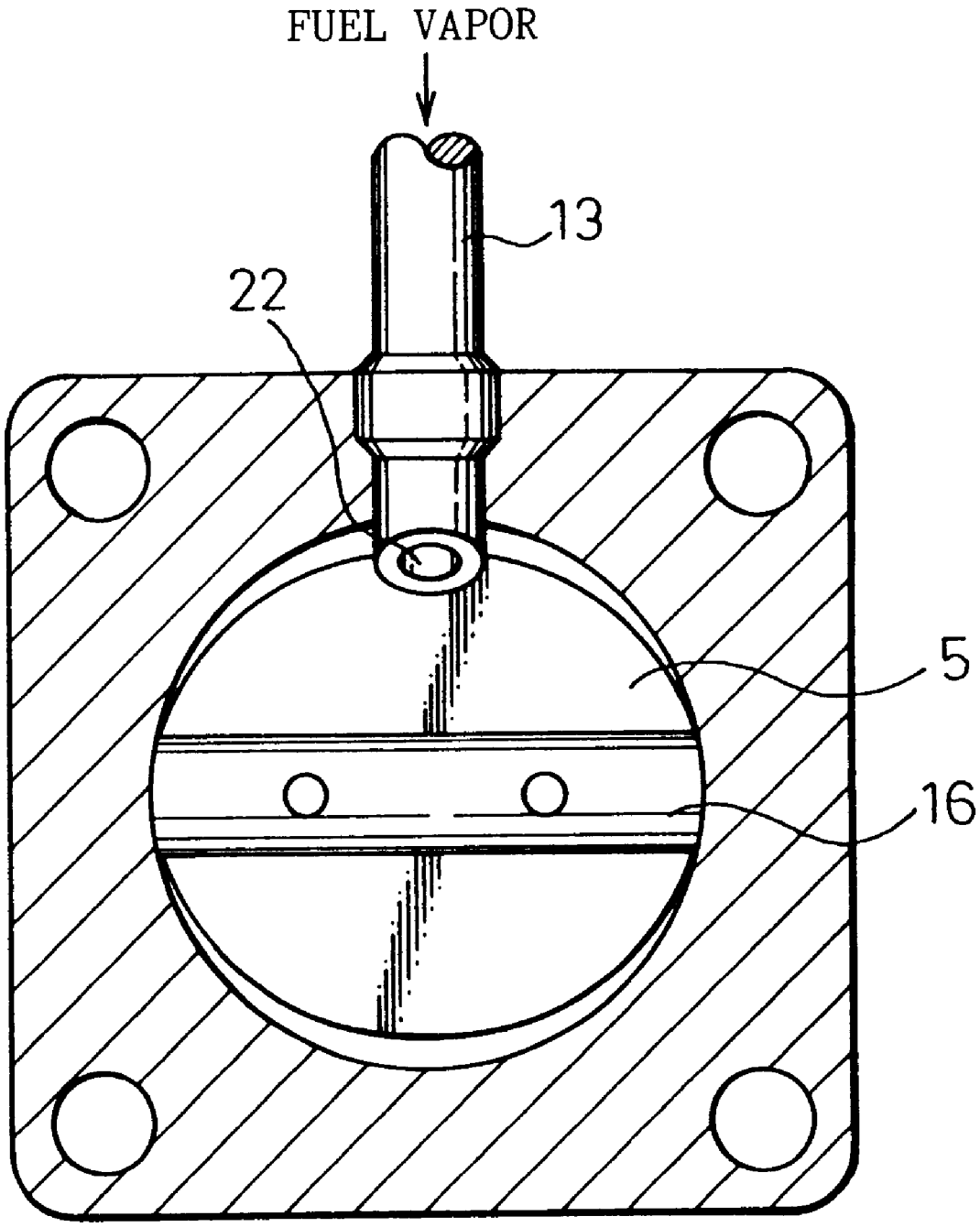
FIG. 9 is a cross-sectional view taken along the line IX—IX of FIG. 8.
Figure 10:
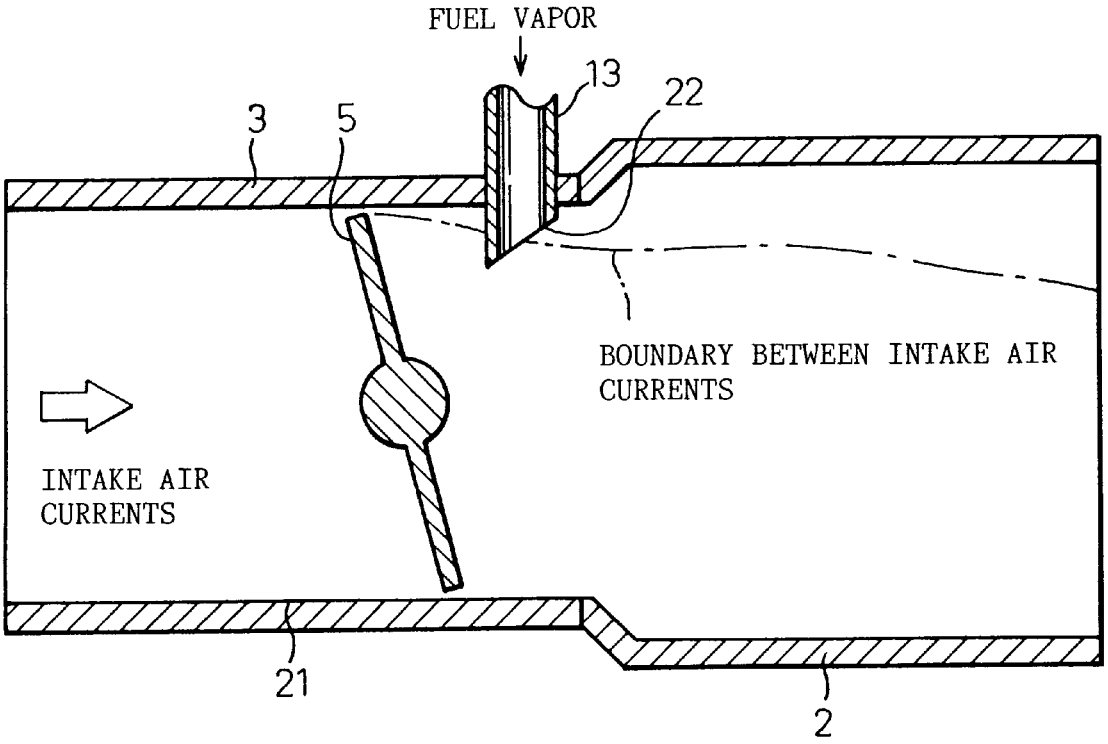
FIG. 10 is a cross-sectional view illustrating a boundary appearing in intake air currents in a throttle bore and a surge tank included in the second embodiment shown in FIG. 8.

Referring to FIGS. 8 through 10, a purge tube 13 accommodated in the second embodiment has a beveled tip, and the purge tube 13 is pressed into a bore 18 formed in an expanded portion 17 having an increased thickness of a throttle body 3 so that the opening 22 in the beveled tip is directed toward a surge tank. The distance between the opening 22 in the beveled tip and the inner surface 21 of the throttle body 3 defining the throttle bore is in the range of 2% to 20% of the diameter of the throttle bore. The surface of an expanded portion 20 of the purge tube 13 for determining the length of a projecting portion of the pure tube 13 projecting from the inner surface 21 may be provided with ridges or knobs by knurling or the like to ensure a firm connection so that the purge tube 13 may not turn relative to the expanded portion 17 and the direction of the opening 22 of the purge tube 13 may not change.

The operation of the second embodiment will be described with reference to FIG. 10. The boundary between intake air currents in the throttle bore extends in a wide range below the throttle valve 5 as indicated by an alternate long and short dash line. The opening 22 of the beveled tip of the purge tube 13 is at a distance equal to 2% to 20% of the diameter of the throttle bore from the inner surface 21 defining the throttle bore on the boundary between forward intake air currents and reverse intake air currents behind the throttle valve 5 and is directed in the direction of flow of intake air. When fuel vapor is spouted through the purge tube 13 thus disposed, fuel vapor flows in the intake manifold 2, diffusing into both the forward intake air currents and the reverse intake air currents. Consequently, fuel vapor is distributed evenly to the respective cylinders and an increase in the difference in the A/F ratio between the cylinders can surely be suppressed.

Figure 11:
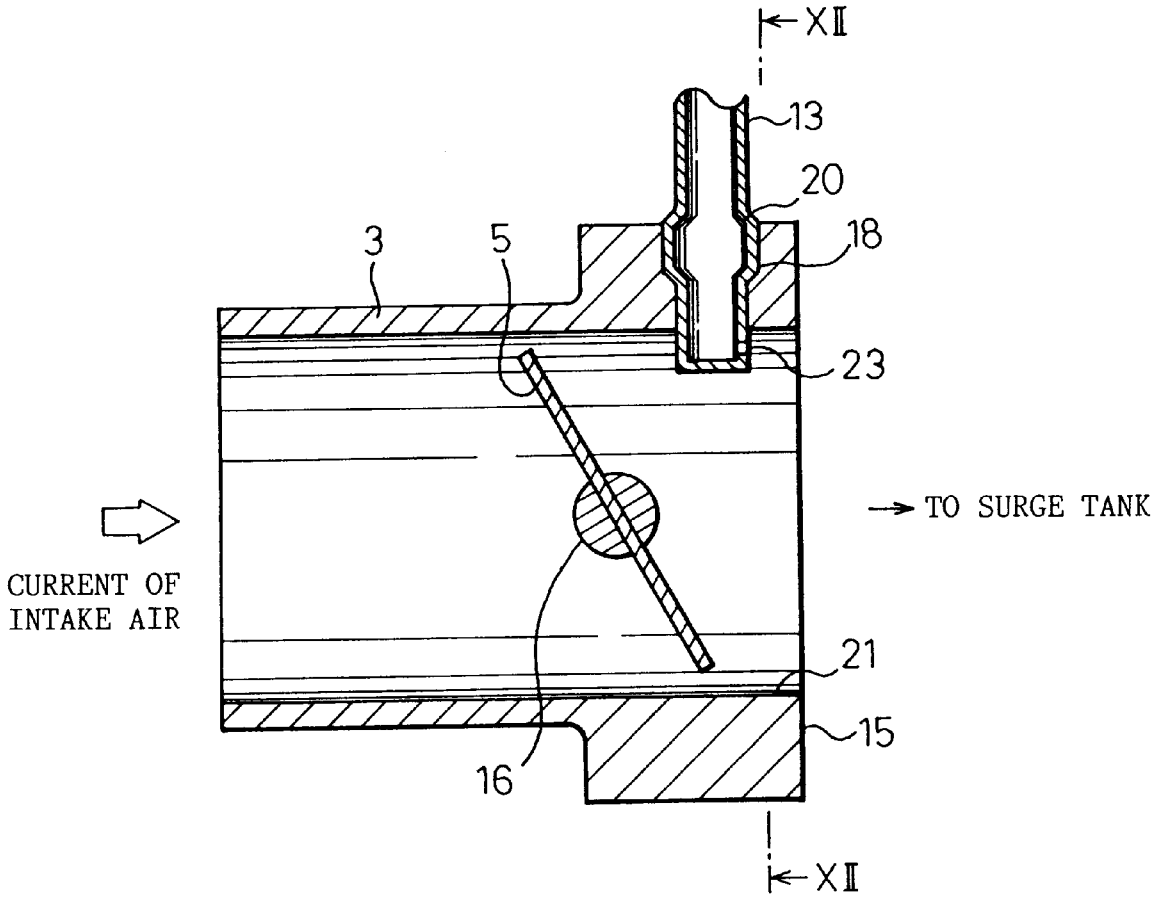
FIG. 11 is a cross-sectional view of a purge tube accommodated in a fuel vapor control system for an internal-combustion engine, according to a third embodiment of the present invention.
Figure 12:
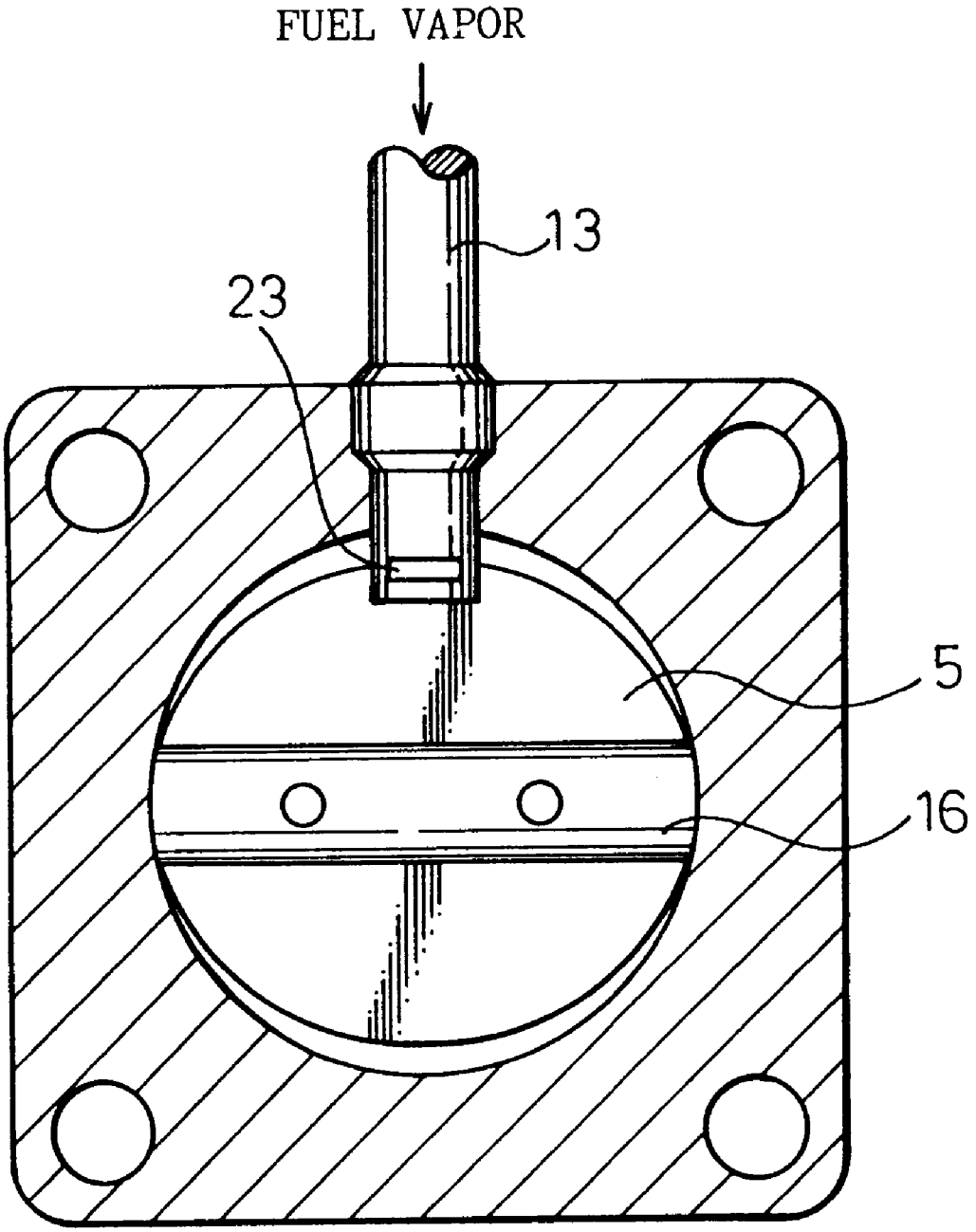
FIG. 12 is a cross-sectional view taken along the line XII—XII of FIG. 11.

FIGS. 11 and 12 illustrate a purge tube accommodated in a fuel vapor control system for an internal-combustion engine according to a third embodiment of the present invention. The purge tube 13 has a closed tip and is provided with a circumferential slit 23 for spouting fuel vapor on the side of a surge tank of a portion near its closed tip. The slit 23 is at a distance equal to 2% to 20% of the diameter of a throttle bore from a surface 21 defining the throttle bore. The surface of an expanded portion 20 of the purge tube 13 for determining the length of a projecting portion of the pure tube 13 projecting from the inner surface 21 is provided with ridges or knobs by knurling or the like to ensure a firm connection so that the direction of the slit 23 may not change. Since the slit 23 is directed in the direction of flow of the boundary between the forward intake air currents and the reverse intake air currents, fuel vapor can surely be spouted through the purge tube 13 into the boundary between the forward intake air currents and the reverse intake air currents, and the third embodiment exercises the same operation and effects as those exercised by the second embodiment.

Figure 13:
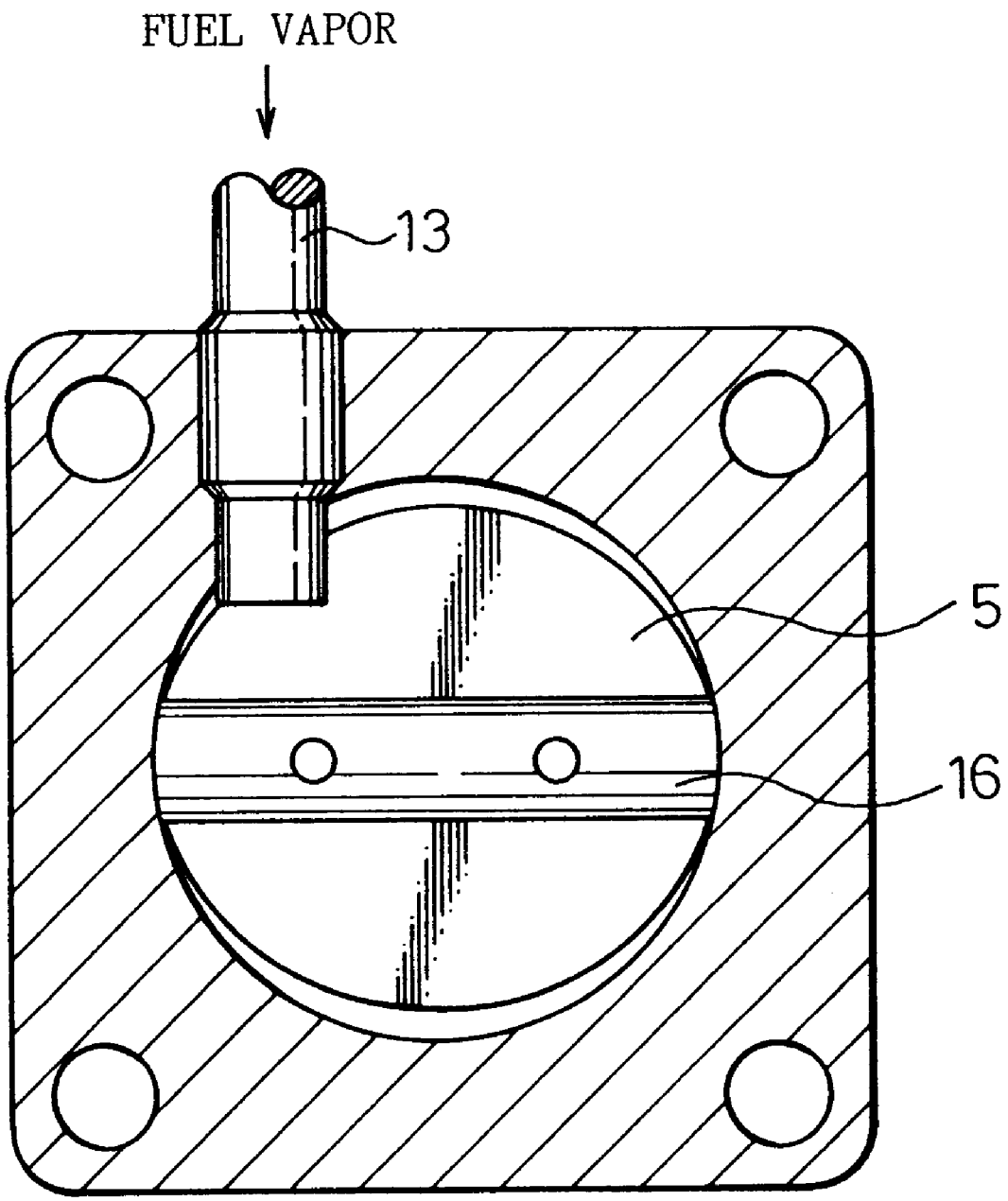
FIG. 13 is a cross-sectional view of a purge tube accommodated in a fuel vapor control system for an internal-combustion engine, according to a fourth embodiment of the present invention.
Figure 14:
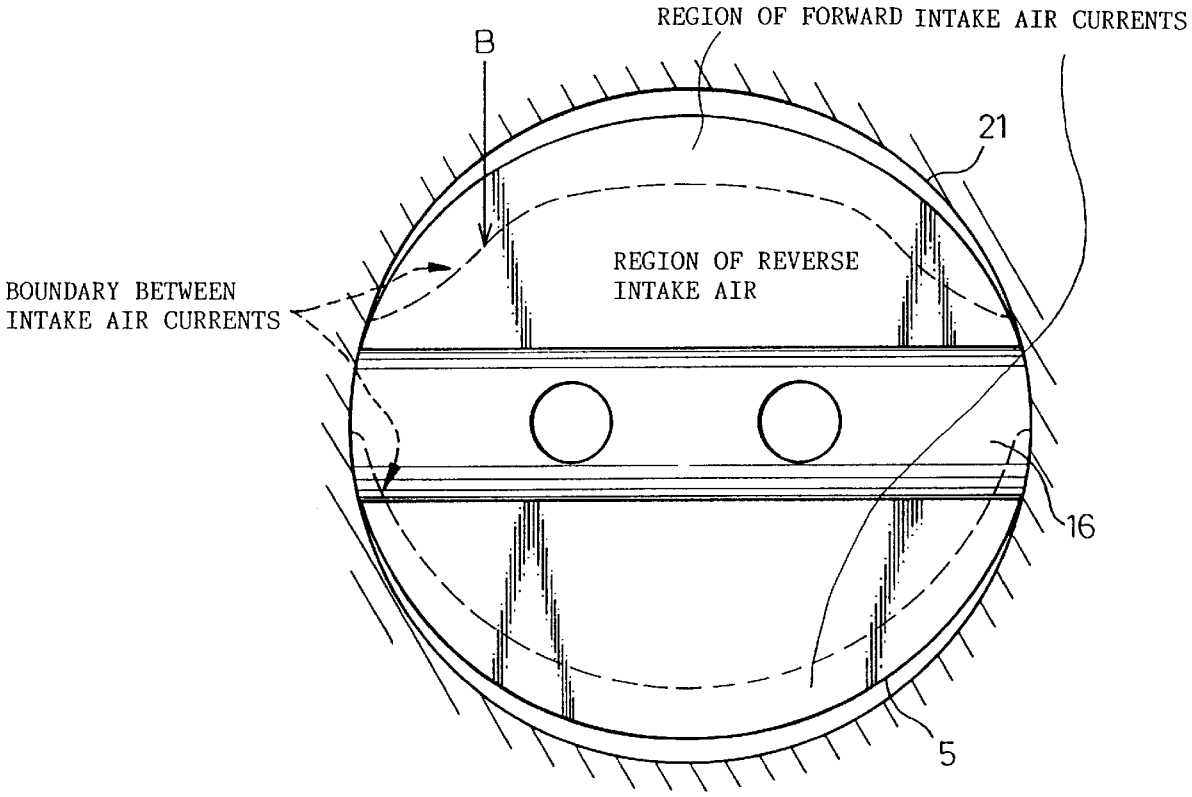
FIG. 14 is a cross-sectional view illustrating respective regions of different currents below a throttle valve in a throttle body in FIG. 13.

FIG. 13 is a sectional view of assistance in explaining a purge tube accommodated in a fuel vapor control system for an internal-combustion engine, according to the fourth embodiment of the present invention. The purge tube 13 similar to that accommodated in the first embodiment is disposed so that its opening is at a position B on the boundary between intake air currents flowing in the forward direction (forward intake air currents) and intake air currents flowing in the reverse direction (reverse intake air currents) as shown in FIG. 14. The position B is biased to the left, as viewed in FIG. 14 with respect to the center of a throttle bore. As shown in FIG. 14, the boundary between the forward intake air currents and the reverse intake air currents produced below a throttle valve extend along the substantially entire inner circumference of a throttle bore in a region at about 5 mm from a surface 21 defining the throttle bore. The variation of the position of a portion of the boundary nearer to a throttle valve shaft 16 with the variation of the angle of a throttle valve is smaller than that of a portion of the boundary farther from the throttle valve shaft 16. Since it is difficult to form a bore at a position near the throttle valve shaft 16 in a throttle body 3, the influence of the angle of the throttle valve on the variation of the position of the boundary can be reduced by disposing the purge tube 13 at a position biased to the right or to the left, as viewed in FIG. 14, with respect to the center within a range meeting restrictive conditions for forming a bore.

Figure 15:
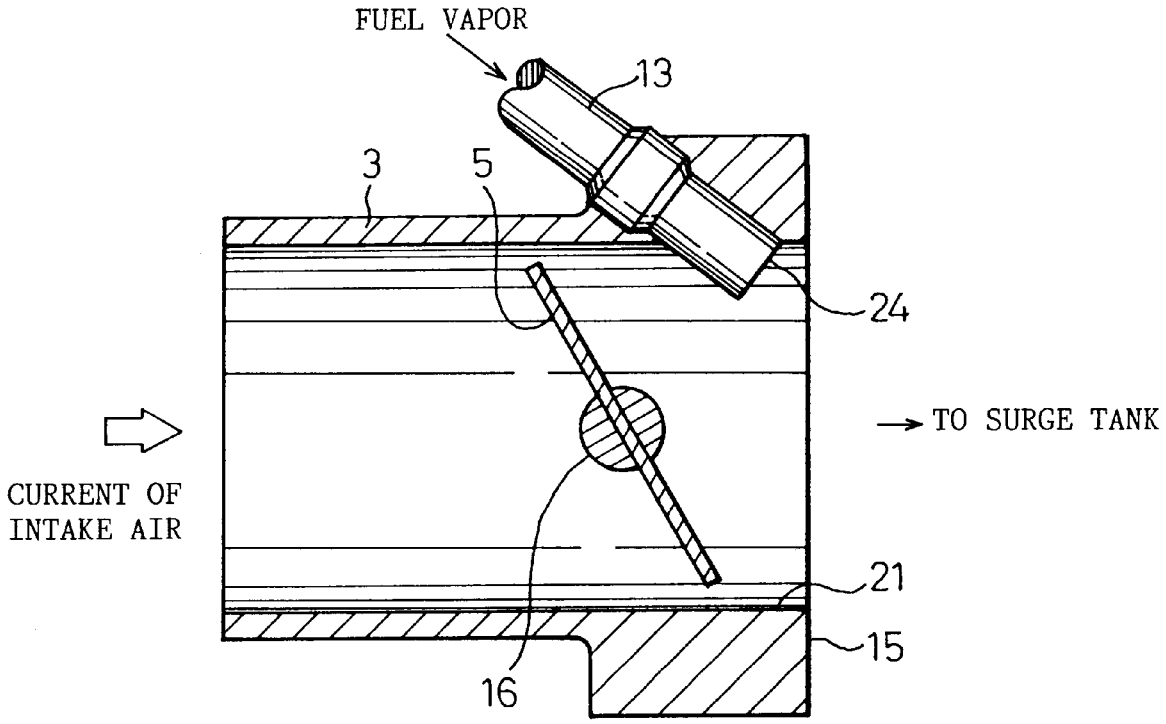
FIG. 15 is a cross-sectional view of a purge tube accommodated in a fuel vapor control system for an internal-combustion engine, according to a fifth embodiment of the present invention.

FIG. 15 illustrates a purge tube accommodated in a fuel vapor control system for an internal-combustion engine according to a fifth embodiment of the present invention.

The fifth embodiment is designed to ensure the operations and effects similar to those of the second embodiment of FIGS. 8 through 10. The purge tube 13 of the fifth embodiment is pressed into a bore formed in a throttle body 3 with its axis inclining to that of the throttle body 3 and an opening 24 formed at its tip confronting a surge tank and directed toward the boundary between forward intake air currents and reverse intake air currents shown in FIG. 10. The opening 24 is at a distance equal to 2% to 20% of the diameter of throttle bore from a surface 21 defining the throttle bore.

The purge tube 13 of this embodiment is advantageous over the purge tube disposed with its axis perpendicular to the boundary in that fuel vapor can surely be jetted onto the boundary even if the distance by which the fuel vapor is able to flow changes owing to the influence of the flow velocity of fuel vapor, provided that the angle of a throttle valve is fixed. The second and the third embodiment also have the same advantage.

Figure 16:
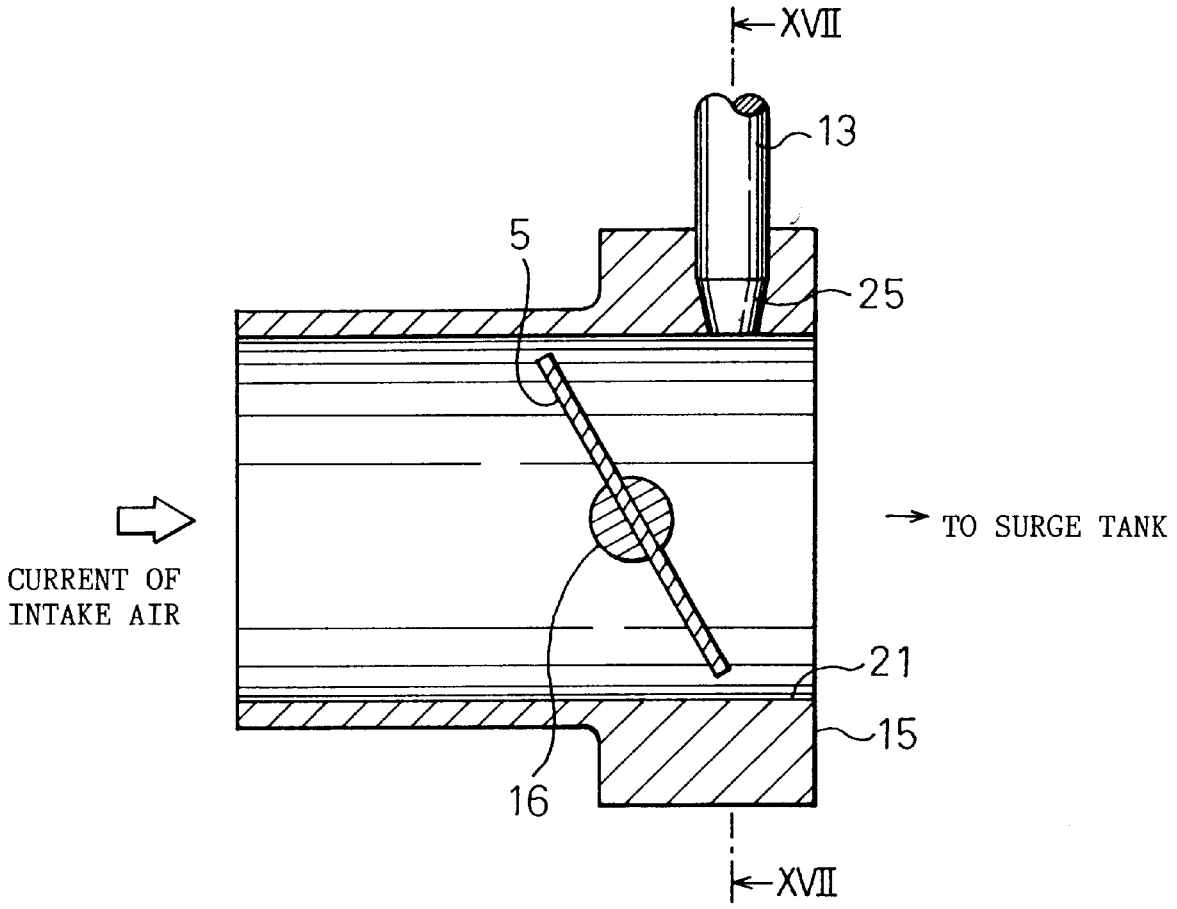
FIG. 16 is a cross-sectional view of a purge tube accommodated in a fuel vapor control system for an internal-combustion engine according to a sixth embodiment of the present invention.
Figure 17:
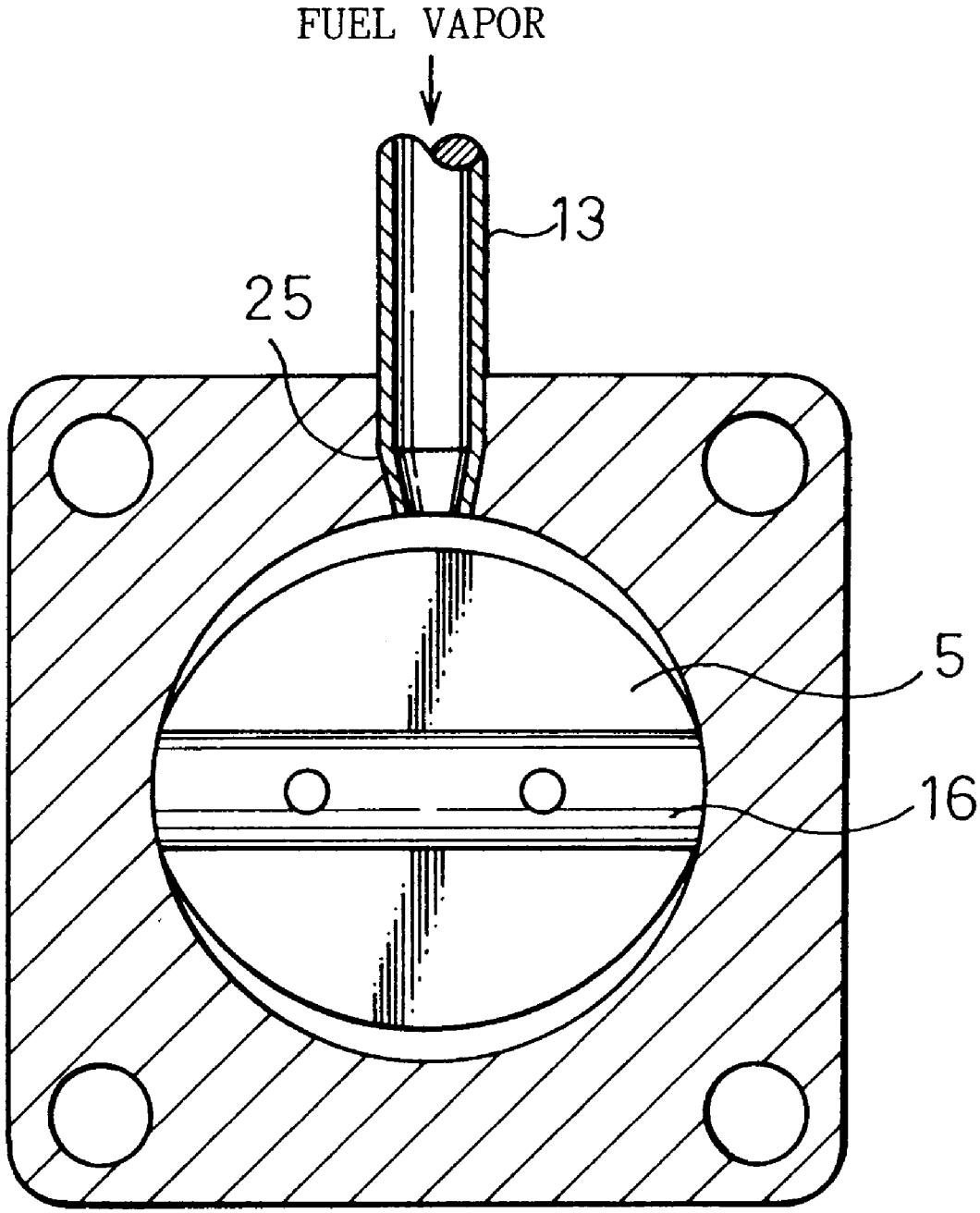
FIG. 17 is a cross-sectional view taken along the line XVII—XVII of FIG. 16.

FIGS. 16 and 17 illustrate a purge tube accommodated in a fuel vapor control system for an internal-combustion engine, according to a sixth embodiment of the present invention.

The purge tube 13 has an inlet opening of 6 mm in diameter, and a tapered end portion 25 tapered toward its extremity and having an outlet opening of 4.0 to 5.0 mm in diameter. The tapered end portion 25 forms a purge port. The inside diameter of the tapered end portion 25 may be decreased toward the extremity as shown in FIG. 17 or may change in steps.

Figure 18:
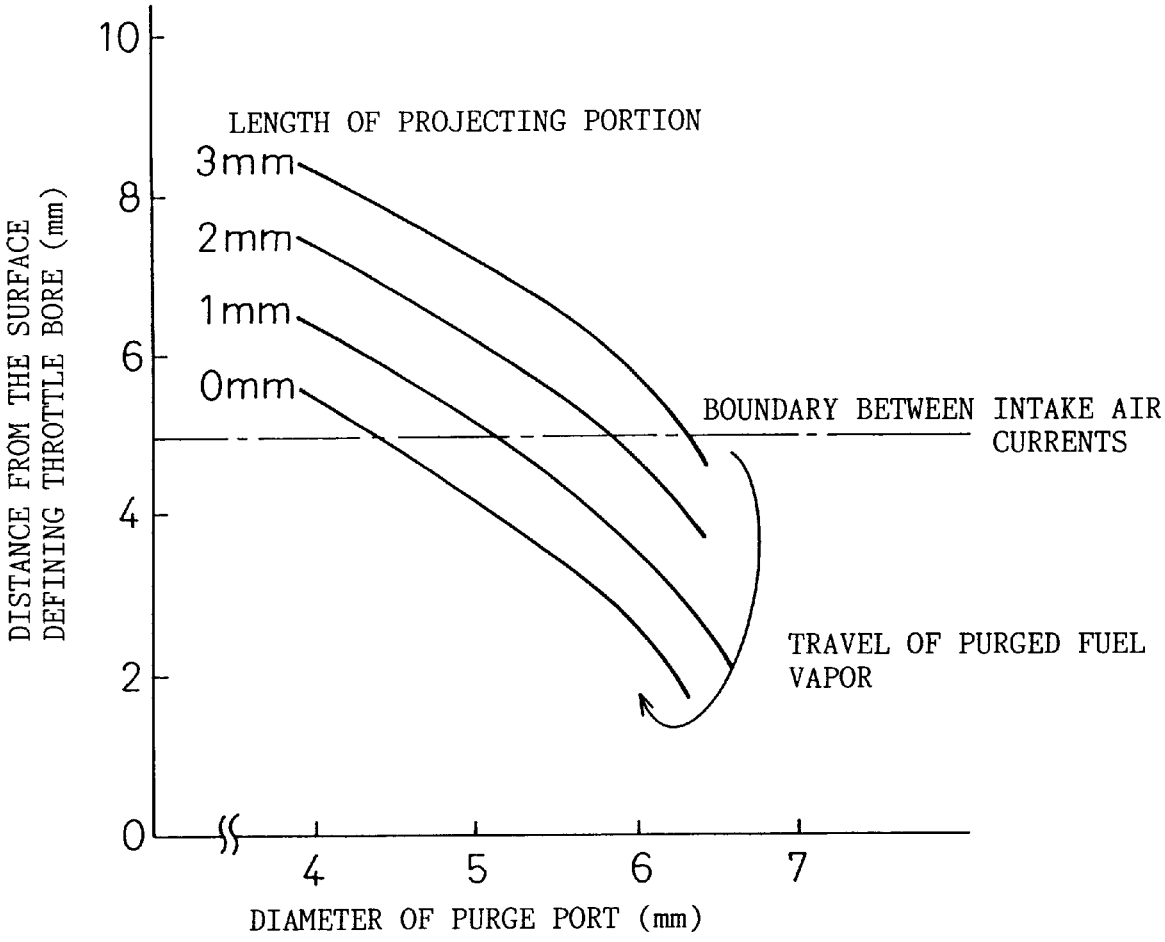
FIG. 18 is a graph showing the position of the boundary between currents, and the position at which a purge gas arrives when the diameter and the distance from the inner surface of a wall defining a throttle bore of a purge port are changed, when the opening of a throttle valve from the closure position is 14°.
Figure 19:
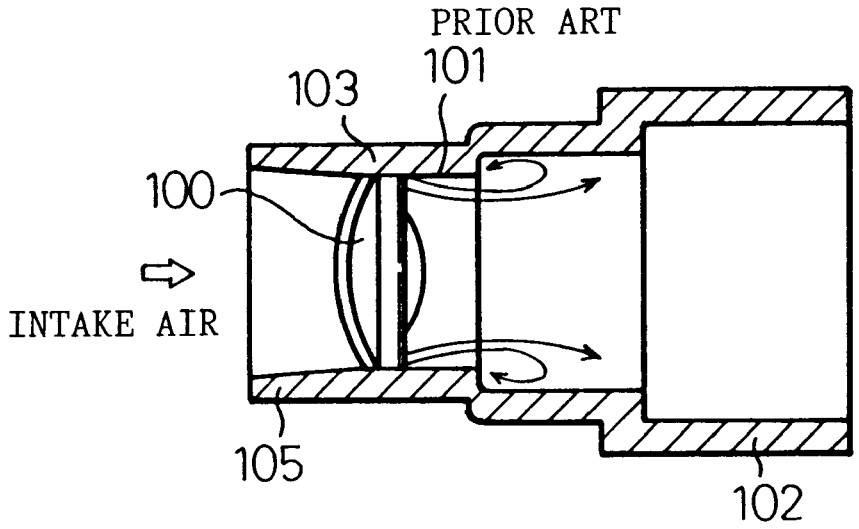
FIG. 19 is a schematic cross-sectional view of a conventional throttle body, illustrating intake air currents in the throttle body.
Figure 20:
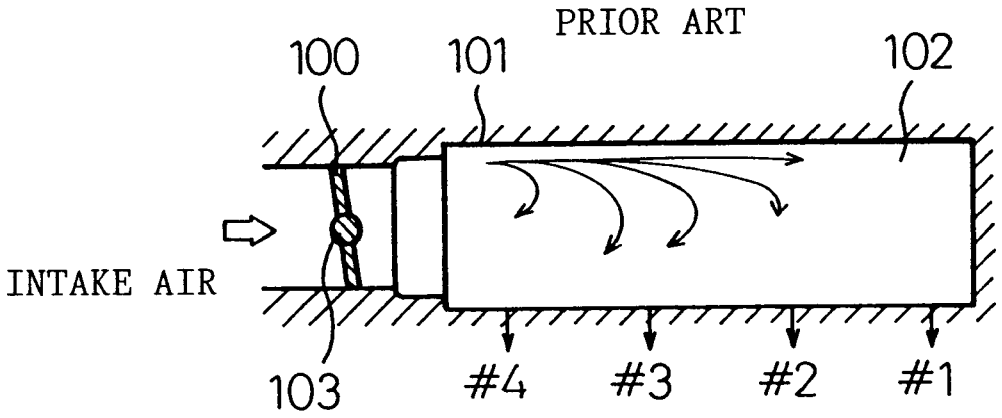
FIG. 20 is a longitudinal cross-sectional view of a conventional surge tank, illustrating intake air currents in the surge tank.
Figure 21:
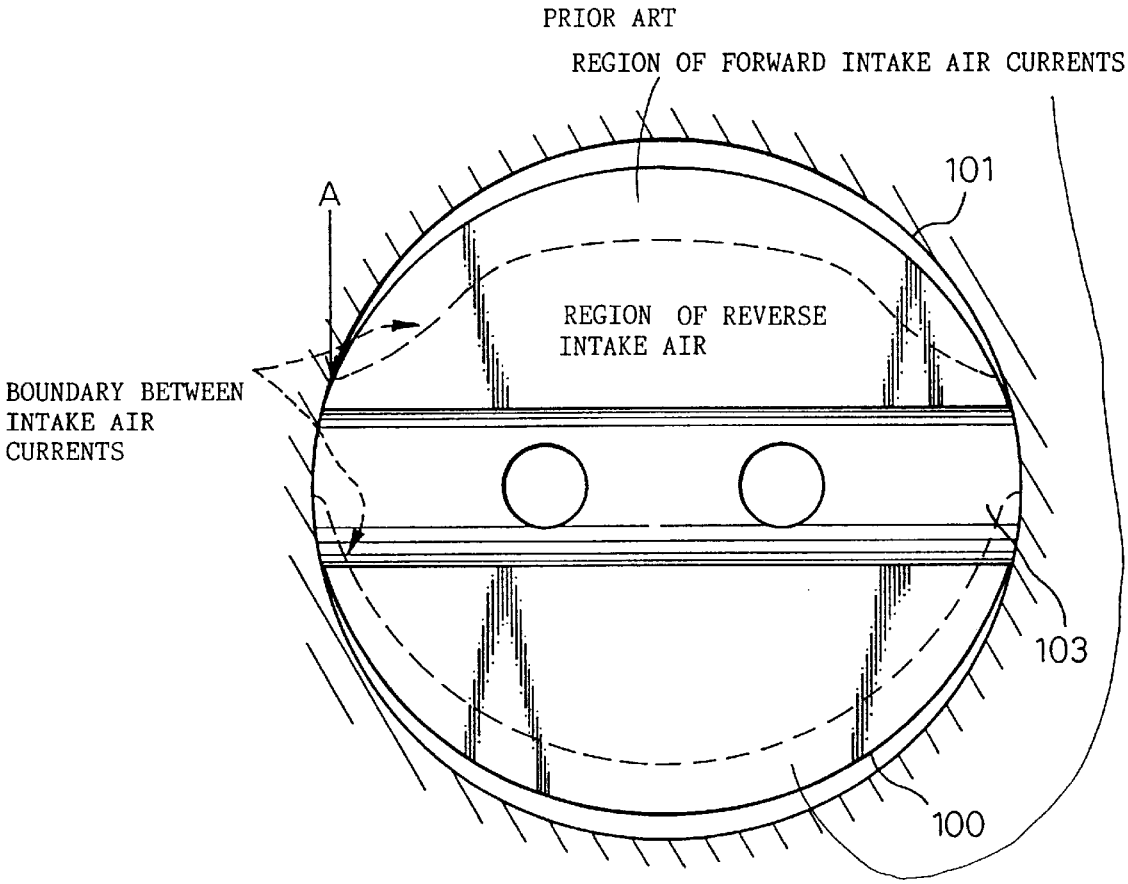
FIG. 21 is a cross-sectional view of a region in which forward currents prevail and a region in which reverse currents prevail in a space below the throttle valve shown in FIG. 20.

FIG. 18 shows the position of the boundary between intake air currents when the angle of a throttle valve is 14°, and a position to which fuel vapor (fuel gas) flows when the diameter of the purge port and the distance between the purge port and the surface defining the throttle bore are changed.

As is obvious from FIG. 18, if the flow rate of fuel vapor is 24 l/min, the jetting speed of fuel vapor jetted through a purge port of 6 mm in diameter is 14.5 m/s when the diameter of the purge port is 6 mm and the fuel vapor jetted through the purge port is able to flow to the boundary between the forward intake air currents and the reverse intake air currents if the purge port is 2 mm from the surface defining the throttle bore. The jetting speed of the purged fuel vapor increases to 27 m/s if the diameter of the purge port is reduced to 4.4 mm, and the fuel vapor is able to flow to the boundary even if the purge port is 0 mm from the surface defining the throttle body.

Since the purged fuel vapor can be made to flow to a desired position by an appropriate combination of the distance between the surface defining the throttle bore and the purge port, the purged fuel vapor can be made to flow to a position on the boundary between forward intake air currents and reverse intake air currents even if the diameter of the throttle and throttle characteristics are changed because the fuel vapor control system is used on a different engine, the sixth embodiment, similarly to the first to the fifth embodiment, is capable of satisfactorily distributing fuel vapor to the cylinders.

As is apparent from the foregoing description, according to the present invention, the purge port is positioned on the boundary between forward intake air currents and reverse intake air currents produced below the throttle valve and hence the fuel vapor jetted through the purge port flows into the surge tank, diffusing into both the forward intake air currents and the reverse intake air currents at the boundary. Consequently, the fuel vapor is distributed evenly to the cylinders, an increase in the difference in A/F ratio between the cylinders can be suppressed, and the difference in A/F ratio between the cylinders does not increase, and the deterioration of drivability and that of the quality of the exhaust gas due to misfiring does not occur even if a large quantity of fuel vapor is purged.

Since an arrangement for attaching the purge tube forming the purge port to the throttle body requires easy machining and assembling work, the manufacturing cost of the fuel vapor control system for an internal-combustion engine, in accordance with the present invention is lower than that of the conventional fuel vapor control system.

It will be understood by those skilled in the art that various modifications and variations of the present invention may be made in the light of the above teachings. It is therefore to be understood that the invention may be practiced otherwise than as specifically described herein without departing from the spirit and scope of the invention as stated in the appended claims.

We claim:

1. A fuel vapor control system for an internal combustion engine, comprising:

a canister packed with an adsorbent capable of adsorbing fuel vapor evaporated in a fuel tank;

a purge port forming means joined into an intake passage of the internal-combustion engine, said purge port forming means having a tapered portion toward its extremity;

a purge passage fluidly interconnecting said canister and said purge port forming means;

a purge rate control means arranged in said purge passage for controlling purge rate at which fuel vapor is purged;

a fuel supply means for supplying fuel to said internal-combustion engine; and a purge correction control means for controlling an operation for supplying fuel to the internal-combustion engine according to the purge rate;

said purge port forming means defining a purge port in said tapered portion, said purge port being formed to direct fuel vapor having passed through said purge passage means toward a boundary between forward intake air currents and reverse intake air currents produced in a region below a throttle valve disposed in the intake passage, to thereby allow the fuel vapor to be jetted onto the boundary.

2. A fuel vapor control system for an internal combustion engine, comprising:

a canister packed with an adsorbent capable of adsorbing fuel vapor evaporated in a fuel tank;

a purge port forming means joined into a throttle body, said throttle body defining a throttle bore forming part of an intake passage of the internal-combustion engine, said purge port forming means including a tube member disposed between a shaft supporting a throttle valve and an end surface of said throttle body connected to a surge tank, said tube member including a projecting portion projecting from a bore surface of said throttle body into the throttle bore and having a length in the range of 2% to 20% of the diameter of the throttle bore;

a purge passage fluidly interconnecting said canister and said purge port forming means;

a purge rate control means arranged in said purge passage for controlling purge rate at which fuel vapor is purged;

a fuel supply means for supplying fuel to said internal-combustion engine; and a purge correction control means for controlling an operation for supplying fuel to the internal-combustion engine according to the purge rate;

said purge port forming means defining a purge port formed to direct fuel vapor having passed through said purge passage means toward a boundary between forward intake air currents and reverse intake air currents produced in a region below the throttle valve, to thereby allow the fuel vapor to be jetted onto the boundary.

3. The fuel vapor control system for an intetnal-combustion engine, according to claim 2, wherein said extremity of said tube is cut so as to form a beveled end surface, and an opening formed in said beveled end surface of said tube opens toward said surge tank.

4. The fuel vapor control system for an internal-combustion engine, according to claim 3, wherein said tube member included in said purge port forming means is held on said throttle body so that said tube member is unable to turn relative to said throttle body.

5. The fuel vapor control system for an internal-combustion engine, according to claim 2, wherein the extremity of said tube member included in said purge port forming means is closed, and at least one circumferential slit for jetting fuel vapor is formed in a portion of a side surface facing said surge tank of said tube member, at a position near said extremity of said tube member.

6. The fuel vapor control system for an internal-combustion engine, according to claim 5, wherein said tube member is held on said throttle body so that said tube member is unable to turn relative to said throttle body.

7. The fuel vapor control system for an internal-combustion engine, according to claim 2, wherein said tube member included in said purge port forming means is biased to the right or to the left with respect to the center of a cross section of said throttle bore.

8. The fuel vapor control system for an internal-combustion engine, according to claim 2, wherein said tube member included in said purge port forming means is attached to said throttle body in an inclined position inclined to said throttle body so that the opening formed in its end surface is directed toward said surge tank.

* * * * *